United States Patent [19]

Tamesui et al.

[11] 3,934,376

[45] Jan. 27, 1976

[54] APPARATUS FOR CONTROLLING THE OPERATION OF A GRINDING WHEEL

[75] Inventors: Tuyoshi Tamesui, Okazaki; Tetsuo Matsuzaki, Nishio, both of Japan

[73] Assignee: Toyoda Koki Kabushiki Kaisha, Japan

[22] Filed: Oct. 22, 1974

[21] Appl. No.: 516,914

[30] Foreign Application Priority Data

Oct. 29, 1973 Japan ..... 48-121453

[52] U.S. Cl. ..... 51/165.91

[51] Int. Cl.[2] ..... B24B 49/04

[58] Field of Search..... 51/165 R, 165.88, 165.91

[56] References Cited

UNITED STATES PATENTS

| | | | |
|---|---|---|---|
| 2,267,391 | 12/1941 | Astrowski | 51/165.91 |
| 3,717,962 | 2/1973 | Kusakabe | 51/165.91 |
| 3,793,775 | 2/1974 | Ishikawa | 51/165.91 |

*Primary Examiner*—Harold D. Whitehead
*Attorney, Agent, or Firm*—Dennison, Dennison, Meserole & Pollack

[57] ABSTRACT

An apparatus for controlling the timing for slowing down the feed of a grinding wheel on a grinding machine against work to enable the wheel to effect a finish cut on the work, in relation to a gradual reduction in the cutting performance of the wheel. The apparatus essentially comprises means for moving the grinding wheel reciprocally relative to the work at a variable speed; a device for measuring the diameter of the work at a plurality of different diametral positions thereof during each cycle of grinding operation and producing a corresponding number of signals each at one of those diametral positions; and an electric circuit adapted to cause the slowing down of the wheel feed upon receiving one of the signals except the last one from the measuring device, while comparing with a predetermined value the time elapsed or the number of pulses counted between receipt of the one signal and the last signal during one cycle of grinding operation and causing the slowing down of the wheel feed during another cycle of grinding operation upon receiving another signal that is produced earlier than the one signal if the above time or number of pulses is exceeded by the predetermined value.

3 Claims, 4 Drawing Figures

1
2
3
4
5
12
29
30
31
W
FF1
FF2
0
1
R
33A
40A
40B
33B
AND4
32
AND1
FF1
39
37
38
36
35
34
AS1
AS2
AS3
AS4
AND3
NOT
AND2

APPARATUS FOR CONTROLLING THE OPERATION OF A GRINDING WHEEL

This invention relates to an apparatus for controlling the operation of a grinding wheel on a grinding machine, and more particularly to an apparatus for controlling the timing for changing the wheel feed to a lower speed at which the grinding wheel provides a finish cut on the work.

When the cutting performance of a grinding wheel on a grinding machine is reduced to the extent that the wheel requires drsssing, the wheel is forced against the work so strongly as to cause the work to bend, especially if the work is an elongate material. Due to its elasticity, the work exerts a considerably great pressure on the grinding wheel, and the wheel and the work act upon each other with a greater pressure than when the work remains in its initial straight shape. As is well known, it is necessary to effect the finish cutting operation at a considerably slower wheel feed to obtain a satisfactory finish on the work than during the rough cutting operation. The greater pressure generated between the grinding wheel and the work, however, prevents the work from being finished with a satisfactory accuracy, even if the wheel feed is slowed down to effect the finish cutting operation. The finish cutting operation comes to an end in a shorter time than is generally necessary. It is difficult to grind a multiplicity of work pieces with a uniformly good accuracy unless the grinding wheel is frequently dressed and eventually changed to a new one.

It is an object of this invention to overcome in a relatively simple and reliable manner the drawbacks of the prior art as mentioned above and provide an apparatus adapted for controlling the operation of a grinding wheel on a grinding machine in order to ensure an optimum timing for a changeover of the wheel feed to effect any finish cutting operation with a satisfactory grinding accuracy irrespective of reduction in the cutting performance of the grinding wheel.

According to this invention, there is provided an apparatus for controlling the timing for slowing down the feed of a grinding wheel for the finish cutting operation, in relation to a gradual reduction in the cutting performance of the wheel. The apparatus of this invention essentially comprises means for moving a rotating grinding wheel reciprocally relative to a piece of work at a variable speed; a device for measuring the varying diameter of said work at at least three different diametral positions thereof during one cycle of grinding operation and producing at least three signals each at one of said diametral positions, the last of said signals indicating the end of said grinding operation, and the second of said signals initially serving to cause variation in said speed to adapt said grinding wheel to effect a finish cut on said work; and an electric circuit adapted to receive said signals and actuate said wheel moving means to cause said variation in said speed upon receiving said last but one signal, while causing retraction of said wheel moving means to a starting position for another cycle of grinding operation upon receiving said last signal, said electric circuit including means for comparing an interval of time between receipt of said second signal and said last signal with a predetermined value, said electric circuit being adapted to cause said variation in said speed upon receiving the first of said signals during said other cycle of grinding operation when said interval is exceeded by said predetermined value during said one cycle of grinding operation.

The invention will now be described by way of example with reference to the accompanying drawings, in which.

Figure 1:
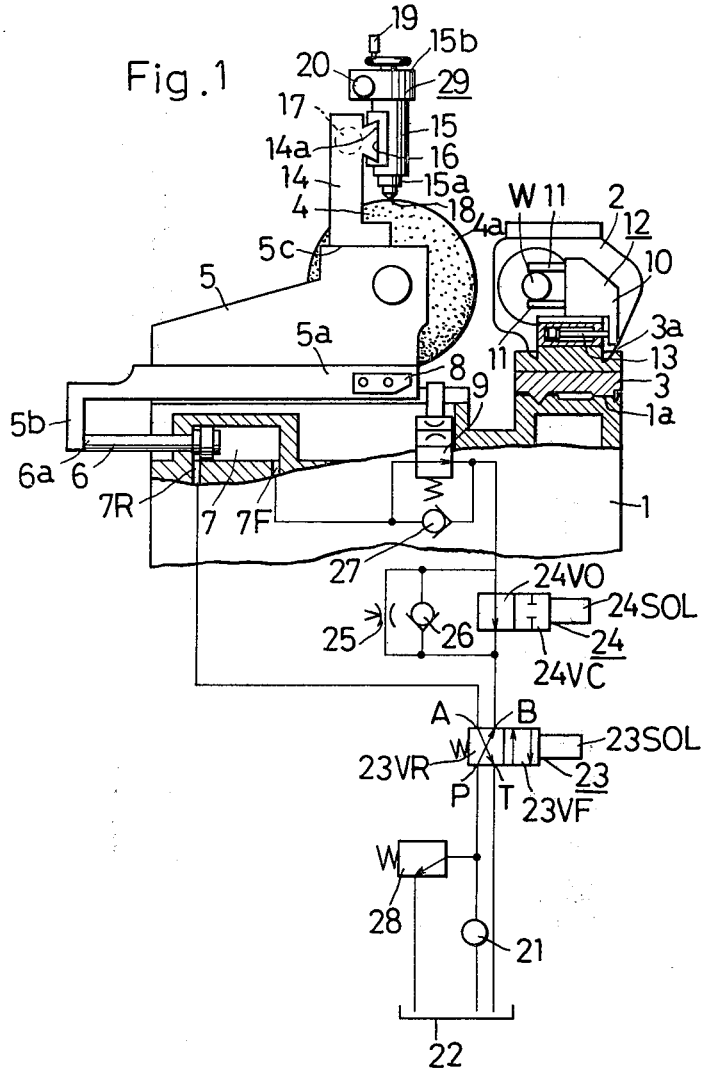
FIG. 1 is a diagrammatic side elevational view of the apparatus according to a preferred embodiment of this invention, including the diagram of a hydraulic circuit.

Referring to the drawings and particularly to FIG. 1 thereof, the apparatus according to a preferred embodiment of this invention is shown with a grinding machine known per se in the art. The machine includes a bed 1 and a work table 3 supported on the upper surface 1*a* of the bed 1 reciprocally movably in a horizontal plane which is perpendicular to the plane of the drawing. The reciprocal movement of the work table 3 is accomplished by a drive mechanism not shown. The work table 3 carries on its upper surface 3*a* a work head 2 which supports a generally cylindrical solid piece of work W in such a manner that the work W may rotate about its own axis. The work W includes an increased diameter portion which defines a cutting allowance. The upper surface 3*a* of the work table 3 also carries a tail stock not shown. The bed 1 further carries on its upper surface 1*a* a grinding wheel carriage 5 in such a manner that the carriage 5 may reciprocally move in a horizontal plane perpendicular to the vertical plane in which the axis of the work W lies. A grinding wheel 4 is mounted on the carriage 5 rotatably about its own axis. The grinding wheel 4 is rotated about its own axis by a motor (not shown) provided on the carriage 5, and the work W by another motor (not shown) provided on the work head 2. The grinding wheel carriage 5 includes a base 5*a* formed with a depending flange 5*b*.

The bed 1 further mounts a hydraulic cylinder 7 which includes a piston rod 6 secured at its outer end 6*a* to the flange 5*b* of the grinding wheel carriage 5. A dog 8 is attached to the base 5*a* of the carriage 5 at the opposite end from the flange 5*b*. A speed reducing valve 9 is provided on the bed 1 adjacent to the dog 8 on the carriage base 5*a* and is adapted for actuation when contacted by the dog 8. Upon actuation of the hydraulic cylinder 7, the grinding wheel carriage 5 advances toward the work W and when the dog 8 is brought into contact with the speed reducing valve 9, the valve 9 is actuated to reduce the speed of the carriage 5 immediately before the grinding wheel 4 starts cutting the work W.

A work measuring device 12, which is known per se, is mounted on the upper surface 3*a* of the work table 3. The device 12 comprises a head 10 and a pair of parallel measuring needles 11 horizontally extending from one side of the head 10. The device 12 is slidable transversely of the axis of the work W to measure the diameter of the work W by inserting its parallel measuring needles 11 over the work W as a cycle of grinding operation proceeds. The work table 3 further supports a hydraulic cylinder 13 which is adapted to reciprocate the measuring device 12 in a horizontal plane perpendicular to the vertical plane in which the axis of the work W lies, whereby the measuring needles 11 are reciprocated between their operative position shown in FIG. 1 and their inoperative position away from the work W.

The grinding wheel carriage 5 supports a bracket 14 on its top surface 5*c* and the bracket 14 includes a dovetail 14*a*. A dressing head 15 includes a dovetail groove 16 slidably engaged with the dovetail 14*a* of the bracket 14, whereby the dressing head 15 is horizontally reciprocable along the thickness of the grinding wheel 4. The bracket 14 supports a hydraulic cylinder 17 which is adapted to reciprocate the dressing head 15 horizontally. A diamond tool 18 is attached to the lower end 15*a* of the dressing head 15 to effect dressing on the peripheral surface 4*a* of the grinding wheel 4 upon actuation of the hydraulic cylinder 17. A handle 19 is provided at the upper end 15*b* of the dressing head 15 to vertically move the diamond tool 18 to adjust its initial projection below the lower end 15*a* of the dressing head 15. The dressing device 29 further includes a hydraulic cylinder 20 which is actuated to increase the projection of the diamond tool 18 below the dressing head 15 progressively at a predetermined rate as a cycle of dressing operation proceeds.

Referring to the hydraulic diagram shown in FIG. 1, the hydraulic circuit for the cylinder 7 includes a first solenoid valve 23 adapted to reverse the direction of travel of the piston rod 6. The valve 23 has a port P connected to a hydraulic pump 21, another port T connected to a tank 22 for hydraulic fluid, still another port A connected to a rear-end port 7R of the cylinder 7 and a further port B connected to a front-end port 7F of the cylinder through a second solenoid valve 24 which is a normally open switching valve and the speed reducing valve 9 connected in series with the valve 24. A flow control valve 25 is connected in parallel to the switching valve 24 and is set in accordance with the finish cutting feed of the grinding wheel 4. Two check valves 26 and 27 are connected in parallel to the switching valve 24 and the speed reducing valve 9, respectively, to stop the hydraulic fluid flowing back from the cylinder 7. A relief valve 28 is connected downstream of the pump 21 to maintain the pressure of the hydraulic fluid at a predetermined level. When the directional control valve 23 and the switching valve 24 are in their respective spring offset positions shown in FIG. 1, the valve 23 is in its rearward position 23VR to retract the piston rod 6 and the valve 24 is in its open position 24VO. The valve 23 includes a solenoid 23SOL adapted, upon energization, to change over the valve 23 to its forward position 23VF to advance the piston rod 6. The valve 24 includes a solenoid 24SOL adapted, upon energization, to bring the valve 24 into its closed position 24 VC.

Figure 2:
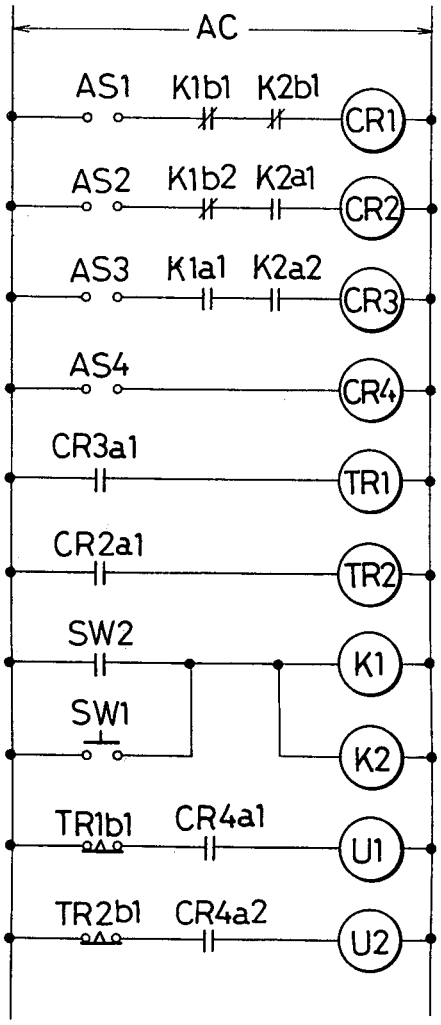
FIG. 2 is an electric diagram for the apparatus shown in FIG. 1.

Reference is now made to FIG. 2 and the electric circuit for the apparatus shown in FIG. 1 will be described.

As the work W is ground to a gradually smaller diameter during one cycle of grinding operation, the measuring device 12 detects the reduction in the diameter of the work W and transmits three signals AS1, AS2 and AS3 as three predetermined diametral positions, respectively, of the work W before the work W is cut to a predetermined final diameter, when a fourth signal AS4 is transmitted by the device 12. One of the three signals AS1, AS2 and AS3 is used as a signal instructing the slowdown of the wheel feed for the finish cutting operation. Whether the signal AS1, AS2 or AS3 may be used depends upon the cutting performance of the grinding wheel 4 during a particular cycle of grinding operation.

The electric circuit shown in FIG. 2 includes a first keep relay K1,U1 having a set coil K1 and a reset coil U1, and a second keep relay K2,U2 having a set coil K2 and a reset coil U2. The keep relay K1,U1 has a normally open contact K1*a*1 and a pair of normally closed contacts K1*b*1 and K1*b*2. The keep relay K2,U2 has a pair of normally open contacts K2*a*1 and K2*a*2 and a normally closed contact K2*b*1. The output terminal AS1 of the measuring device 12 which transmits a first signal AS1 is connected in series with the normally closed contacts K1*b*1 and K2*b*1. A relay CR1 is connected with a power source AC through the output terminal AS1 and the normally closed contacts K1*b*1 and K2*b*1. The output terminal AS2 of the device 12 which transmits a second signal AS2 is connected in series with the normally closed contact K1*b*2 of the keep relay K1,U1 and the normally open contact K2*a*1 of the keep relay K2,U2. A relay CR2 is connected with the power source AC through the output terminal AS2 and the contacts K1*b*2 and K2*a*1. The output terminal AS3 of the measuring device 12 which transmits the third signal AS3 is connected in series with the normally open contact K1*a*1 of the keep relay K1,U1 and the normally open contact K2*a*2 of the keep relay K2,U2. A relay CR3 is connected with the power source AC through the output terminal AS3 and the contacts K1*a*1 and K2*a*2. A relay CR4 is connected with the power source AC through the output terminal AS4 of the measuring device 12 which transmits the fourth signal AS4. The relay CR3 includes a normally open contact CR3*a*1, through which a timer TR1 is connected with the power source AC. The relay CR2 includes a normally open contact CR2*a*1, through which a timer TR2 is connected with the power source AC. The circuit further includes a push-button switch SW1 adapted, when pressed, to start the operation of the apparatus, and a second switch SW2 indicating the end of the dressing operation. The switch SW2 is connected in parallel to the switch SW1 and is automatically turned on upon completion of the dressing operation effected by the diamond tool 18 on the grinding wheel 4. The set coils K1 and K2 of the keep relays K1,U1 and K2,U2, respectively, are connected in parallel to each other and connected with the power source AC through the switches SW1 and SW2. The relay CR4 includes a pair of normally open contacts CR4*a*1 and CR4*a*2. The timer TR1 includes a normally closed contact TR1*b*1 and the timer TR2 includes a normally closed contact TR2*b*1. The normally open contact CR4*a*1 of the relay CR4 is connected in series with the normally closed contact TR1*b*1 of the timer TR1. The reset coil U1 of the keep relay K1,U1 is connected with the power source AC through the contacts CR4*a*1 and TR1*b*1. The normally open contact CR4*a*2 of the relay CR4 is connected in series with the normally closed contact TR2*b*1 of the timer TR2. The reset coil U2 of the keep relay K2,U2 is connected with the power source AC through the contacts CR4*a*2 and TR2*b*1.

Figure 3:
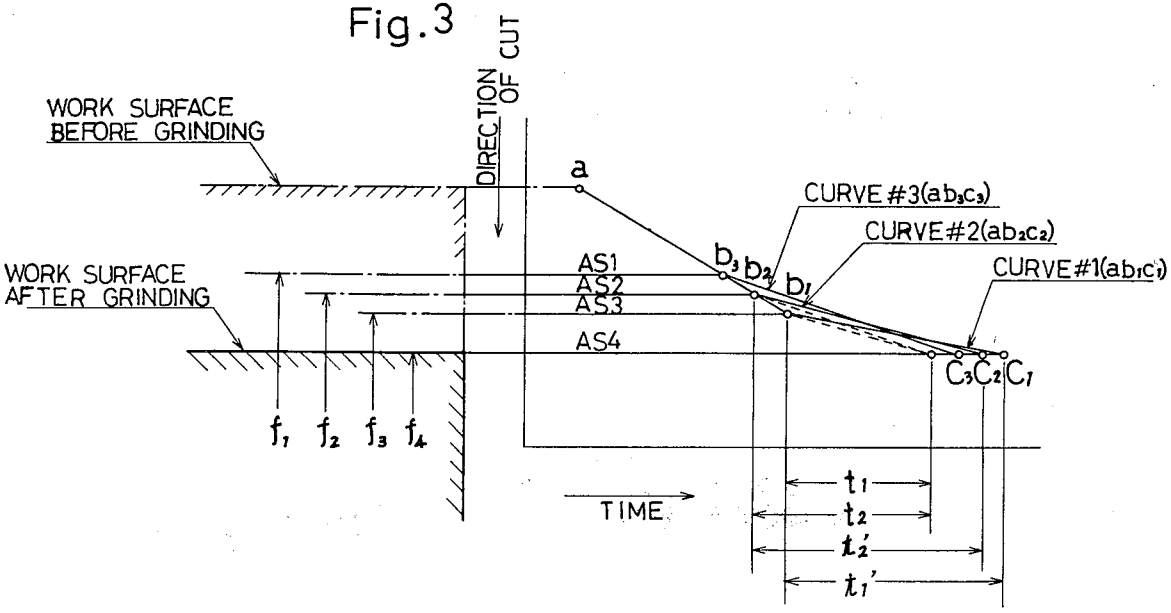
FIG. 3 is a graph illustrating the operation of the apparatus of this invention.

Attention is now directed to FIG. 3 for description of the operation of the apparatus. As the cutting performance of the grinding wheel 4 becomes lower during a particular cycle of grinding operation, the grinding wheel 4 is forcibly fed against the work W without effecting satisfactory grinding in the rough cutting process, so that the work W is gradually caused to bend. Let it be assumed that the feed of the grinding wheel 4 is slowed down to effect finish cutting on the work W in response to the third signal AS3. The flexion of the work W in the rough cutting process has developed an increased amount of pressure between the grinding wheel 4 and the work W. The increased pressure causes the finish cutting operation to finish in a shorter time than is required to cut away the same amount of material from the work W in its non-bent position. Such reduction in time is represented in FIG. 3 by the shift of the point $c_1$ to the left along the line AS4. In FIG. 3, the dimension $f_3$ is the diameter of the work W at which the feed of the grinding wheel 4 is to be slowed down for the finish cutting operation to grind the work W down to its predetermined final diameter $f_4$. As is readily understood from the graph of FIG. 3, however, the finish cutting operation would be substantially nothing but an extension of the rough cutting operation so long as the work W remains bent. Accordingly, as the amount of the flexion of the work W during the rough cutting operation approaches the amount of the material to be cut away from the work W during the finish cutting operation as indicated by the distance $f_3$–$f_4$ in FIG. 3, the grinding accuracy for the work W gradually gets worse. According to this invention, the minimum length of time allowable for the finish cutting operation at which it is still possible to maintain an acceptable grinding accuracy despite the reduction in the cutting performance of the grinding wheel 4 is represented as $t_1$ in FIG. 3 and the time $t_1$ is set on the timer TR1. Curve No. 1 formed by connecting the points $a$, $b_1$ and $c_1$ in FIG. 3 illustrates the characteristics of the grinding operation in which the work W is ground without undergoing any flexion.

The push-button switch SW1 is pressed to set the keep relays K1,U1 and K2,U2 and start a cycle of grinding operation. The solenoid 23SOL is energized and the grinding wheel carriage 5 advances. The speed reducing valve 9 is actuated by the dog 8 and the speed of the carriage 5 is lowered to enable the grinding wheel 4 to start the rough cutting of the work W. As the keep relays K1,U1 and K2,U2 are both in their set positions, the contacts K1*a*1, K2*a*1 and K2*a*2 are closed and the contacts K1*b*1, K1*b*2 and K2*b*1 are open, contrary to the illustration of FIG. 2. As the rough cutting operation proceeds, the first signal AS1 is transmitted by the measuring device 12 when the work W is cut down to the dimension $f_1$ and likewise, the second signal AS2 is produced when the work W is cut down further to the dimension $f_2$. Nevertheless, the grinding wheel 4 continues to be fed against the work W at the same speed and the rough cutting operation continues in accordance with the characteristics of curve No. 1 (FIG. 3). As the rough cutting operation further proceeds, the work W is cut down to the dimension $f_3$, which corresponds to the point $b_1$ on curve No. 1, whereupon the measuring device 12 produces the third signal AS3. The timer TR1 is actuated and the solenoid 24SOL is energized, whereby the feed of the grinding wheel 4 is slowed down to start the finish cutting operation.

While the grinding wheel 4 still retains a good cutting performance which does not cause any flexion in the work W, merely the pressure produced by the cylinder 7 acts on the grinding wheel 4 and the work W does not impart any counter-pressure against the grinding wheel 4. Accordingly, the finish cutting operation is carried out at a due speed or in a time $t'_1$ in accordance with curve No. 1. The time $t_1$ set on the timer TR1 elapses before the work W is cut down to its final dimension $f_4$ and the measuring device 12 produces the signal AS4 which indicates the end of the finish cutting operation. Accordingly, despite the energization of the relay CR4, the keep relay K1,U1 is not reset, but the solenoid 23SOL is deenergized by the relay CR4 to retract the grinding wheel carriage 5. Then, the machine repeats another cycle of grinding operation for a new piece of work in accordance with curve No. 1.

After repetition of a number of cycles of grinding operation in the same way, the cutting performance of the grinding wheel 4 is lowered to the extent which causes flexion in the work W. The flexion of the work W causes reduction in the finish cutting time and the time $t'_1$ eventually becomes equal to or shorter than the time $t_1$ set on the timer TR1. The signal AS4 is transmitted simultaneously with or before the elapse of the time $t_1$. Due to the energization of the relay CR4 with its contact CR4*a*1 closed, the reset coil U1 is energized to reset the keep relay K1,U1 because the contact TR1*b*1 of the timer TR1 still remains in its closed position. Upon deenergization of the solenoid 23SOL by the relay CR4, the grinding wheel carriage 5 retracts and another cycle of grinding operation is started. The grinding wheel 4 is first moved forward at a fast rate and upon actuation of the valve 9 by the dog 8, the feed of the wheel 4 is slowed down for the rough cutting operation, all in the same manner as hereinbefore described. It will, however, be noted that as the keep relay K1,U1 is in its reset position, the circuitry of the contacts K1*a*1 and K2*a*2 is now open and the circuitry of the contacts K1*b*2 and K2*a*1 closed, while the circuitry of the contacts K1*b*1 and K2*b*1 remains open. Accordingly, neither the relay CR1 nor CR3 is energized even if the measuring device 12 produces the first signal AS1 or third signal AS3. When the work W is cut down to the dimension $f_2$, which is a diametral position where the wheel feed is to be slowed down for the finish cutting operation as indicated at the point $b_2$ on curve No. 2 in FIG. 3, the measuring device 12 produces the second signal AS2 and the timer TR2 is actuated. The solenoid 24SOL is energized and the feed of the grinding wheel 4 is slowed down to start the finish cutting operation at the position $f_2$. As far as there has not been any appreciable further reduction in the cutting performance of the grinding wheel 4, the finish cutting operation proceeds in accordance with the characteristics of curve No. 2 as indicated at the portion $b_2$– $c_2$ and takes time $t'_2$ as shown in FIG. 3. The time $t_2$ set on the timer TR2 elapses before completion of the finish cutting operation. This indicates that it is all right to continue a further cycle or cycles of grinding operation in accordance with the characteristics of curve No. 2. Thus, additional cycles of grinding operation are repeated by changing the wheel feed to initiate the finish cutting operation upon transmission of the second signal AS2.

Further reduction then takes place in the cutting performance of the grinding wheel 4, resulting in additional flexion of the work W and reduction in the time for the finish cutting operation until the time $t'_2$ becomes equal to, or less than the time $t_2$ set on the timer TR2. This is the situation in which it is undesirable to continue following curve No. 2 if an acceptable grinding accuracy is to be obtained. The measuring device 12 produces the signal AS4 simultaneously with or earlier than the elapse of the time $t_2$ set on the timer TR2. Due to energization of the relay CR4, with its contact CR4*a*2 closed, the reset coil U2 is energized to reset the keep relay K2,U2 because the contact TR2*b*1 of the timer TR2 still remains in its closed position. Upon deenergization of the solenoid 23SOL by the relay CR4, the grinding wheel carriage 5 retracts and a further cycle of grinding operation is started. It will, however, be noted that as the keep relay K2,U2 has been reset, the circuitry of the contacts K1*b*2 and K2*a*1 is now open and the circuitry of the contacts K1*b*1 and K2*b*1 closed, while the circuitry of the contacts K1*á*1 and K2*a* 2 remains open. Accordingly, neither the relay CR2 or CR3 is energized even if the measuring device 12 transmits the signal AS2 or AS3. On the other hand, the relay CR1 is energized when the work W is cut down to the dimension $f_1$ and the signal AS1 is transmitted from the device 12. The solenoid 24SOL is energized to slow down the wheel feed to initiate the subsequent finish cutting operation at the diametral position $f_1$ or point $b_3$ on the curve No. 3 in FIG. 3. Thus, the finish cutting operation follows the characteristics of curve No. 3, more particularly, the segment $b_3$–$c_3$ thereof.

The grinding machine is provided with a device for counting the number of the cycles of grinding operation which may be repeated, i.e., the number of the pieces of work which may be ground with an acceptable grinding accuracy before the grinding wheel dressing. This counting device is known per se and not shown in the drawings, nor is any detailed description made in respect thereof. A predetermined number of operation cycles or work pieces is set on the counting device. When the device has counted up the preset number, after completion of a plurality of cycles of grinding operation in accordance with curve No. 3 following the operation according to curves No. 1 and No. 2, the counting device transmits a corresponding signal which serves as a signal instructing the start of a cycle of dressing operation, whereby the diamond tool 18 dresses the grinding wheel 4. Upon completion of the dressing operation, the switch SW2 is turned on automatically and the keep relays K1,U1 and K2,U2 are brought back to their respective set positions. The machine is now ready for repeating a predetermined number of grinding operation in accordance with the characteristics of curves No. 1, No. 2 and then No. 3, as hereinbefore described, until the grinding wheel requires another cycle of dressing operation.

Figure 4:
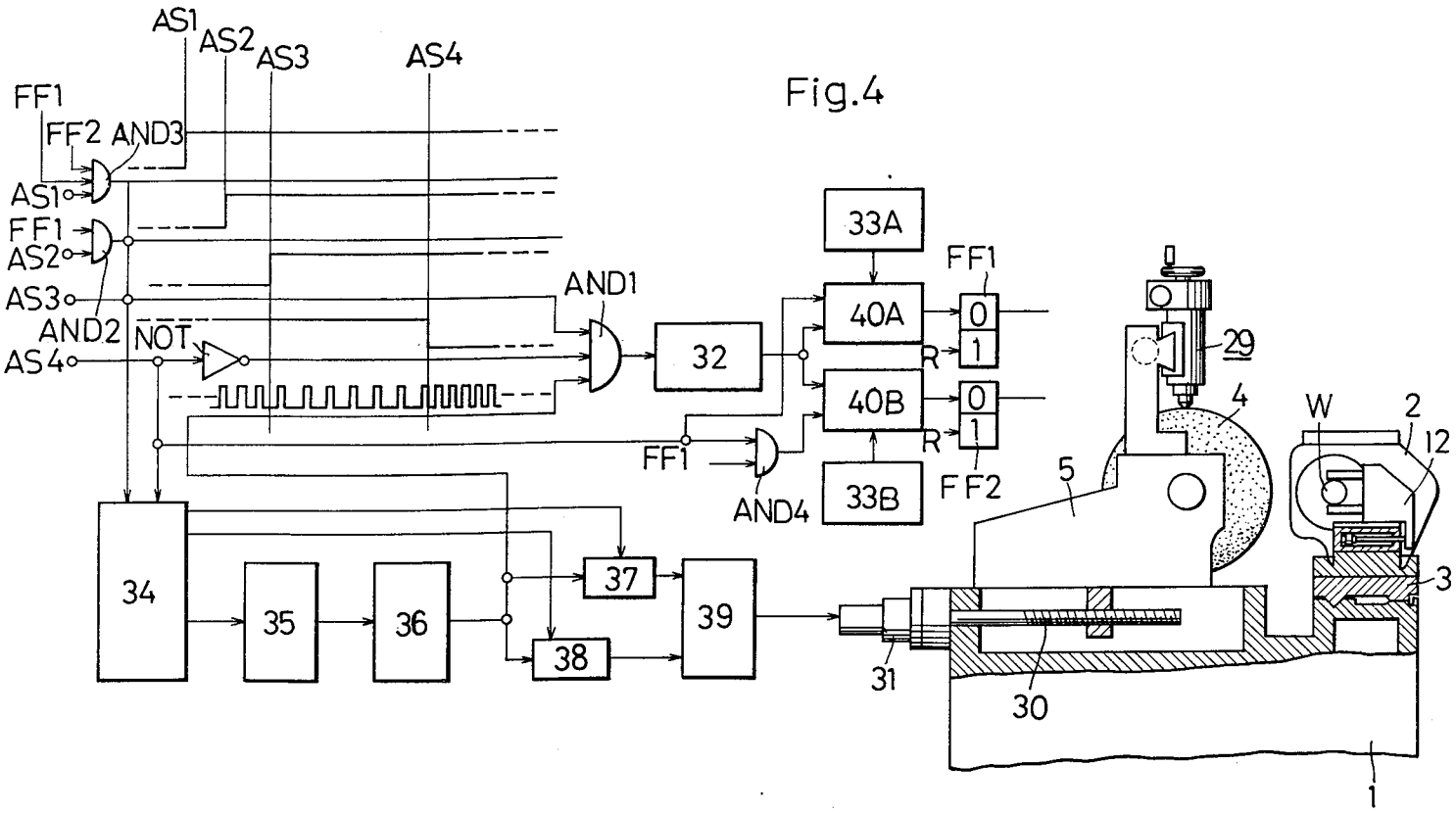
FIG. 4 is a diagrammatic side elevational view of the apparatus according to another embodiment of this invention, including an electric diagram.

Referring to FIG. 4, the apparatus according to another embodiment of this invention is associated with a screw rod 30 which is driven by a pulse motor 31 to move the grinding wheel carriage 5 forward or backward. The apparatus includes a counting device 32 adapted to count in terms of the number of pulses the length of time actually required for a particular cycle of finish cutting operation. The number of pulses corresponding to the time $t_1$ is set on a first digital switch 33A and the number of pulses corresponding to the time $t_2$ is set on a second digital switch 33B. The output of the counting device 32 is compared with the number of pulses set on the digital switch 33A or 33B as will hereinafter be described. A main control circuit 34 produces a control signal and this control signal is transmitted through a speed changing circuit 35 to a pulse oscillator 36. The pulse oscillator 36 generates pulses with a frequency corresponding to the feed of the grinding wheel 4. The pulses generated by the oscillator 36 are transmitted to a pulse motor driving circuit 39 through a forward rotation gate 37 or a reverse rotation gate 38. The forward and reverse rotation gates 37 and 38 are actuated in response to the control signal transmitted from the main control circuit 34. The pulse motor driving circuit 39 produces an output signal which causes the pulse motor 31 to rotate in a forward or reverse direction at a variable speed required for moving the grinding wheel carriage 5 at a desired speed.

A first AND gate AND1 is provided to receive the output signal AS3 of the measuring device 12 which is a signal for effecting a particular cycle of finish cutting operation in accordance with the characteristics of curve No. 1 in FIG. 3. The output signal AS4 of the measuring device 12 which indicates the end of the finish cutting operation is transmitted to the gate AND1 through an inverter NOT. The gate AND1 also receives the output pulses of the oscillator 36 and transmits an output to the counting device 32. When the signal AS4 is produced by the measuring device 12, an output from the counting device 32 is compared in a first comparison circuit 40A with the value set on the first digital switch 33A. When the number of the pulses counted by the counting device 32 is smaller than the number of the pulses set on the digital switch 33A, the comparison circuit 40A generates an output to set a first memory circuit FF1. When the memory circuit FF1 is in its set position, the counting device 32 receives the output pulses of the oscillator 36 generated during the period between the transmission of the signals AS2 and AS4 by the measuring device 12. When the signal AS4 is transmitted from the measuring device 12, the output signal of the counting device 32 is compared in a second comparison circuit 40B with the value set on the second digital switch 33B. If the number of the pulses counted by the counting device 32 is smaller than the number of the pulses set on the digital switch 33B, the comparison circuit 40B generates an output to set a second memory circuit FF2.

With the first and second memory circuits FF1 and FF2 in their respective set positions, the counting device 32 receives the output pulses generated by the oscillator 36 during the period between the transmission of the signals AS1 and AS4 by the measuring device 12. When the two memory circuits FF1 and FF2 are reset, the main control circuit 34 actuates the speed changing circuit 35 in response to the signal AS3 from the measuring device 12, whereby the pulse motor 31 causes the screw rod 30 to slow down the feed of the grinding wheel 4 to start the finish cutting operation. The speed changing circuit 35 is actuated in response to the signal AS2 when only the first memory circuit FF1 is set, and in response to the signal AS1 when the two memory circuits FF1 and FF2 are both set.

In operation, the numbers of the pulses corresponding to the time $t_1$ and $t_2$ in FIG. 3 are set on the two digital switches 33A and 33B, respectively. In other words, the number of the pulses to be set on the first digital switch 33A is the number of the pulses to be generated by the oscillator 36 and received in the counting device 32 during a period equal to the time $t_1$, while the number of the pulses to be set on the second digital switch 33B is the number of the pulses to be generated by the oscillator 36 and received in the counting device 32 during a period equal to the time $t_2$. The machine is placed in operation and the grinding wheel carriage 5 is advanced at a fast-forward speed. In response to a signal from the main control circuit 34, the carriage 5 lowers its adavancing speed and the grinding wheel 4 starts rough cutting of the work W. As the rough cutting operation proceeds, the measuring device 12 produces a signal AS1 and then another signal AS2. Insofar as the two memory circuits FF1 and FF2 are both in their reset positions, however, the grinding wheel carriage 5 does not change its speed, but the grinding wheel 4 continues the rough cutting operation in accordance with the characteristics of curve No. 1 in FIG. 3. When the work W is then cut down to the dimension $f_3$, the measuring device 12 generates a third signal AS3, whereby the feed of the grinding wheel 4 is slowed down to start the finish cutting operation. As the output signal AS3 of the measuring device 12 is "1", and as a fourth signal AS4 which remains "0" is inverted to "1" by the inverter NOT, the pulses generated by the oscillator 36 are transmitted through the AND gate AND1 into the counting device 32. The work W is then cut down to its final dimension $f_4$ and the fourth signal AS4 is generated by the measuring device 12. In this case, if there is no appreciable reduction in the cutting performance of the grinding wheel 4, the finish cutting operation requires the time $t'_1$ in accordance with curve No. 1 in FIG. 3. The number of the pulses received by the counting device 32 (which corresponds to the distance covered by the grinding wheel carriage 5 traveling at a constant speed) during the finish cutting operation is compared in the first comparison circuit 40A with the number of the pulses set on the first digital switch 33A. No output is, however, generated by the comparison circuit 40A, because the number of the pulses received by the counting device 32 is larger than the number set on the digital switch 33A. Accordingly, after retraction of the grinding wheel carriage 5, the machine repeats another cycle of grinding operation in accordance with the characteristics of curve No. 1.

After a number of cycles of grinding operation are repeated in accordance with the characteristics of curve No. 1, the cutting performance of the grinding wheel 4 is lowered to such an extent that the time $t'_1$ actually required for the finish cutting operation is equal to the set time $t_1$ or less. When the fourth signal AS4 is generated by the measuring device 12, the number of the pulses received by the counting device 32 is smaller than the number of the pulses set on the first digital switch 33A. The comparison circuit 40A generates an output to set the first memory circuit FF1. The grinding wheel carriage 5 retracts and the machine is started for another cycle of grinding operation. The carriage 5 first advances at a fast rate and then reduces its speed to start rough cutting of a new piece of work W. The operation proceeds in the same way as hereinbefore described, and a first signal AS1 is ignored. The situation is, however, different when the work W is cut down to the dimension $f_2$, and a second signal AS2 is generated by the measuring device 12. Since the first memory circuit FF1 is now in its set position, the second signal AS2 serves as a signal instructing the changeover of the wheel feed. The work W starts to undergo finish cutting operation at its diametral position $f_2$ and the operation will continue in accordance with the characteristics of curve No. 2 in FIG. 3. As long as there is no appreciable additional reduction in the cutting performance of the grinding wheel 4, the number of the pulses received by the counting device 32 during the period between the transmission of the signals AS2 and AS4 is greater than the number set on the second digital switch 33B, so that the second comparison circuit 40B does not generate any output. This indicates that a particular cycle of finish cutting operation is carried out in an adequate length of time which is not too short to maintain an acceptable grinding accuracy. Accordingly, an additional number of cycles of grinding operation will be repeated to grind a corresponding number of pieces of work W in accordance with the characteristics of curve No. 2.

After repetition of the grinding operation by following curve No. 2, however, the cutting performance of the grinding wheel 4 is further reduced to the extent that the time $t'_2$ actually required for the finish cutting operation is equal to, or less than the time $t_2$ set on the second digital switch 33B in terms of the number of pulses. The number of the pulses received by the counting device 32 during the period between the output signals AS2 and AS4 of the measuring device 12 is now smaller than the number of the pulses set on the digital switch 33B. Therefore, the second comparison circuit 40B produces an output to set the second memory circuit FF2. The grinding wheel carriage 5 retracts and the machine is placed in another cycle of grinding operation. The carriage 5 first advances at a fast speed and then reduces its speed to start rough cutting of a new piece of work W. The operation proceeds in the same manner as hereinbefore described, until the work W is cut down to its diametral dimension $f_1$, and a first signal AS1 generated by the measuring device 12. As the two memory circuits FF1 and FF2 are now in their set positions, the first signal AS1 is not ignored, but serves as a signal instructing the changeover of the wheel feed. The work W is placed in finish cutting operation when it has rough cut to the dimension $f_1$, and the operation will thus continue in accordance with the characteristics of curve No. 3 in FIG. 3.

The grinding wheel 4 is worn and requires dressing after a number of cycles of grinding operation in accordance with curve No. 3. This may be ascertained, and the wheel 4 dressed, just as already described in connection with the apparatus of FIG. 1. As soon as the dressing of the wheel 4 is over, a signal indicating the end of the dressing operation is received in the electric circuit from an appropriate device not shown, whereby the two memory circuits FF1 and FF2 are both reset. The machine is then ready for continuing the grinding operation again in accordance with the characteristics of curves No. 1, No. 2 and then No. 3 in FIG. 3.

It will be understood from the foregoing description that with the apparatus of this invention, it is readily possible to maintain an acceptable grinding accuracy of a grinding machine over a prolonged period of time without requiring too frequent dressing of a grinding wheel, by detecting a gradual reduction in the cutting performance of the grinding wheel in terms of the time required for finish cutting operation and progressively increasing the amount of material to be cut in the finish cutting process relatively to the amount of material to be cut in the rough cutting process.

While the invention has been described with reference to a couple of preferred embodiments thereof, it will be understood that further variations or modifications may be easily made by anyone of ordinary skill in the art without departing from the scope of this invention which is defined by the appended claims.

What is claimed is:

1. An apparatus for controlling the operation of a grinding wheel on a grinding machine, wherein said grinding wheel is fed against a generally cylindrical workpiece at a rough grinding speed during a rough grinding operation for said workpiece and at a fine grinding speed lower than said rough grinding speed during a finish grinding operation following said rough grinding operation, said apparatus comprising:

means for moving said grinding wheel reciprocally relative to said workpiece at a variable speed including said rough and fine grinding speeds;

a device for measuring a diameter of said workpiece to generate at least first, second and third signals responsive to predetermined large, intermediate and small diameters of said workpiece during one cycle of grinding operation, said third signal indicating the end of said one cycle of grinding operation;

means for initially causing variation of said variable speed from said rough grinding speed to said fine grinding speed in response to said second signal;

means for comparing with a predetermined value an interval of time between generation of said second and third signals; and means for causing variation of said variable speed from said rough grinding speed to said fine grinding speed in response to said second signal in a following cycle when said interval is longer than said predetermined value and for causing variation of said variable speed from said rough grinding speed to said fine grinding speed in response to said first signal in said following cycle when said interval is exceeded by said predetermined value.

2. An apparatus for controlling the operation of a grinding wheel on a grinding machine, wherein said grinding wheel is fed against a generally cylindrical workpiece at a rough grinding speed during a rough grinding operation for said workpiece and at a fine grinding speed lower than said rough grinding speed during a finish grinding operation following said rough grinding operation, said apparatus comprising;

means for moving said grinding wheel reciprocally relative to said workpiece at a variable speed including said rough and fine grinding speeds;

a device for measuring a diameter of said workpiece to generate at least first, second and third signals responsive to predetermined large, intermediate and small diameters of said workpiece during one cycle of grinding operation; said third signal indicating the end of said one cycle of grinding operation;

first relay means, when energized in response to said first signal, for causing variation of said variable speed from said rough grinding speed to said fine grinding speed;

second relay means, when energized in response to said second signal, for causing variation of said variable speed from said rough grinding speed to said fine grinding speed;

timer means actuated by energization of said second relay means; and means for causing said first and second relay means to be inoperative and operative, respectively, in a following cycle when said timer means is timed out before said third signal is generated and for causing said first relay means to be operative in said following cycle when said timer means is timed out after said third signal is generated.

3. An apparatus for controlling the operation of a grinding wheel on a grinding machine, wherein said grinding wheel is fed against a generally cylindrical workpiece at a rough grinding speed during a rough grinding operation for said workpiece and at a fine grinding speed lower than said rough grinding speed during a finish grinding operation following said rough grinding operation, said apparatus comprising:

an oscillator for generating pulses;

a pulse motor responsive to said pulses from said oscillator for moving said grinding wheel reciprocally relative to said workpiece at a variable speed including said rough and fine grinding speeds;

a device for measuring a diameter of said workpiece to generate at least first, second and third signals responsive to predetermined large, intermediate and small diameters of said workpiece during one cycle of grinding operation, said third signal indicating the end of said one cycle of grinding operation;

means for initially causing variation of said variable speed from said rough grinding speed to said fine grinding speed in response to said second signal;

means for counting the number of said pulses generated by said oscillator between generation of said second and third signals;

at least one digital switch for setting a predetermined value in terms of a predetermined number of pulses;

at least one comparison circuit for comparing the content of said counting means with said predetermined value set on said digital switch; and means for continuing variation of said variable speed from said rough grinding speed to said fine grinding speed in response to said second signal in a following cycle when the content of said counting means is larger than said predetermined value and for causing variation of said variable speed from said rough grinding speed to said fine grinding speed in response to said first signal in said following cycle when the content of said counting means is exceeded by said predetermined value.

* * * * *